US007982563B2

(12) United States Patent
Debarnot et al.

(10) Patent No.: US 7,982,563 B2
(45) Date of Patent: Jul. 19, 2011

(54) DUAL-ACTUATION-MODE CONTROL DEVICE

(75) Inventors: Miguel Debarnot, Brignoud (FR); Laurent Chiesi, Reaumont (FR)

(73) Assignee: Schneider Electric Industries SAS, Rueil-Malmaison (FR)

( * ) Notice: Subject to any disclaimer, the term of this patent is extended or adjusted under 35 U.S.C. 154(b) by 233 days.

(21) Appl. No.: 12/358,538

(22) Filed: Jan. 23, 2009

(65) Prior Publication Data

US 2009/0189720 A1 Jul. 30, 2009

(30) Foreign Application Priority Data

Jan. 30, 2008 (FR) ..... 08 50574

(51) Int. Cl.
*H01H 51/22* (2006.01)

(52) U.S. Cl. ..... 335/78; 335/79; 335/84; 335/205; 335/207; 335/234

(58) Field of Classification Search ..... 335/78–86, 335/205–207, 234
See application file for complete search history.

(56) References Cited

U.S. PATENT DOCUMENTS 6,016,092 A * 1/2000 Qiu et al. ..... 333/262
6,469,603 B1 * 10/2002 Ruan et al. ..... 335/78
7,482,899 B2 * 1/2009 Shen et al. ..... 335/78
2002/0121951 A1 * 9/2002 Shen et al.
2007/0018762 A1 * 1/2007 Wheeler et al.
2007/0018766 A1 * 1/2007 Poyner ..... 335/306
2009/0302981 A1 * 12/2009 Chiesi et al. ..... 335/205

FOREIGN PATENT DOCUMENTS

FR 2 880 730 * 7/2006
FR 2 899 720 * 10/2007
WO WO 2006/131520 A1 * 12/2006

* cited by examiner

*Primary Examiner* — Ramon M Barrera
(74) *Attorney, Agent, or Firm* — Oblon, Spivak, McClelland, Maier & Neustadt, L.L.P.

(57) ABSTRACT

The present invention relates to a control device (1, 1') of an electrical circuit comprising:

a microswitch (2, 2') comprising a moving element that can be driven by magnetic effect between a first stable state and a second stable state to control the electrical circuit, a fixed permanent magnet (10, 10'), a moving permanent magnet (11, 11') that can be actuated between a first position, in which it forms, with the fixed permanent magnet (10, 10'), a substantially uniform permanent magnetic field ($B_0$) holding the moving element in the first state or the second state, and a second position in which it is able to control the switchover of the moving element from one state to the other, an excitation coil (4) able to create a temporary magnetic field (Bb) able to cause the moving element to switch over from one state to the other when the moving permanent magnet (11, 11') is in the first position.

14 Claims, 3 Drawing Sheets

DUAL-ACTUATION-MODE CONTROL DEVICE

The present invention relates to a control device of an electrical circuit. This control device presents the particular feature of having two distinct actuation modes.

The patent WO2006/131520 discloses a button in which an MEMS membrane is actuated by moving a moving permanent magnet relative to a fixed permanent magnet. The moving permanent magnet is moved between a rest position and a working position. The MEMS membrane is in a first state when the moving permanent magnet is in its rest position, the latter state being maintained by the magnetic field generated by the fixed permanent magnet. The MEMS membrane changes to a second state when the moving permanent magnet is in its working position under the combined influence of the magnetic fields generated by the fixed permanent magnet and the moving permanent magnet. When the moving permanent magnet returns to its rest position, the MEMS membrane returns to its first state.

Moreover, as described in the patent U.S. Pat. No. 6,469,602, it is known to move an MEMS membrane between two states using a planar coil incorporated in the substrate and a fixed permanent magnet generating a permanent magnetic field. The membrane is maintained in each of its states under the influence of the magnetic field generated by the fixed permanent magnet whereas the coil creates a temporary magnetic field making it possible to switch over the membrane from one state to the other.

For certain applications, it is advantageous to be able to have a control device in which the moving element can be actuated in two distinct ways. However, it is necessary for the control device to remain particularly compact.

The aim of the invention is to propose a control device that can be actuated in two distinct ways, that is simple to use, easy to manufacture, reliable and particularly compact.

This aim is achieved by a control device of an electrical circuit comprising:

- a microswitch comprising a moving element that can be driven by magnetic effect between a first stable state and a second stable state to control the electrical circuit,
- a fixed part made of magnetic material,
- a moving permanent magnet that can be actuated between a first position, in which it forms, with the fixed part, a substantially uniform permanent magnetic field holding the moving element in the first state or the second state, and a second position in which it is able to control the switchover of the moving element from one state to the other,
- an excitation coil able to create a temporary magnetic field able to cause the moving element to switch over from one state to the other when the moving permanent magnet is in the first position.

According to a particular feature, the fixed element made of magnetic material is a permanent magnet.

According to another particular feature, the moving permanent magnet and the fixed permanent magnet have magnetizations of parallel direction and of the same direction.

According to another particular feature, the magnetic field created by the coil is substantially perpendicular to the magnetization directions of the fixed and moving permanent magnets.

According to a first embodiment, the moving permanent magnet is able to be moved perpendicularly to its direction of magnetization. In this case, the microswitch is centred relative to the fixed and moving permanent magnets.

According to a second embodiment, the moving permanent magnet is able to be moved parallel to its direction of magnetization. In this case, the microswitch is off-centred relative to the fixed and moving permanent magnets.

According to the invention, the moving element of the microswitch is a ferromagnetic membrane that can be oriented along magnetic field lines.

According to the invention, after actuation, the moving permanent magnet is automatically returned from its second position to its first position. This return can be carried out by the magnetic effect between the fixed and moving permanent magnets or by the use of a mechanical part of the return spring type.

According to the invention, the operation of the device can be as follows:

- the moving element is initially held in the first state, then
- the moving element is switched over to the second state by movement of the moving permanent magnet to its second position,
- the moving element is returned to its first state by activation of the coil once the moving permanent magnet has returned to its first position.

The first state of the moving element is, for example, an open state in which the electrical circuit is open and the second state of the moving element is, for example, a closed state in which the electrical circuit is closed.

According to the invention, the device can be used to eliminate the leakage or standby currents in a system by disconnecting the electrical circuit by activation of the coil and by re-engaging the electrical circuit using the moving permanent magnet.

The device can also be used in a circuit breaker to automatically disconnect the electrical circuit in the case of an electrical fault using the excitation coil and then manually reclose the electrical circuit using the moving permanent magnet.

Other characteristics and advantages will emerge from the detailed description that follows by referring to a given embodiment by way of example and represented by the appended drawings in which.

The invention consists in proposing a control device 1, 1' provided with two distinct actuation modes. This type of control device is of particular interest in certain applications that will be specified hereinafter.

The inventive control device 1, 1' operates using a microswitch 2, 2' comprising a moving element that can be driven by magnetic effect. This microswitch 2, 2' can in particular be an MEMS (Micro-Electro Mechanical System) comprising a membrane 20, 20' provided with a ferromagnetic layer (for example of permalloy) and able to be aligned and to be oriented along the magnetic field lines to assume two distinct stable states, for example an open state of an electrical circuit and a closed state of the electrical circuit.

Figure 1:
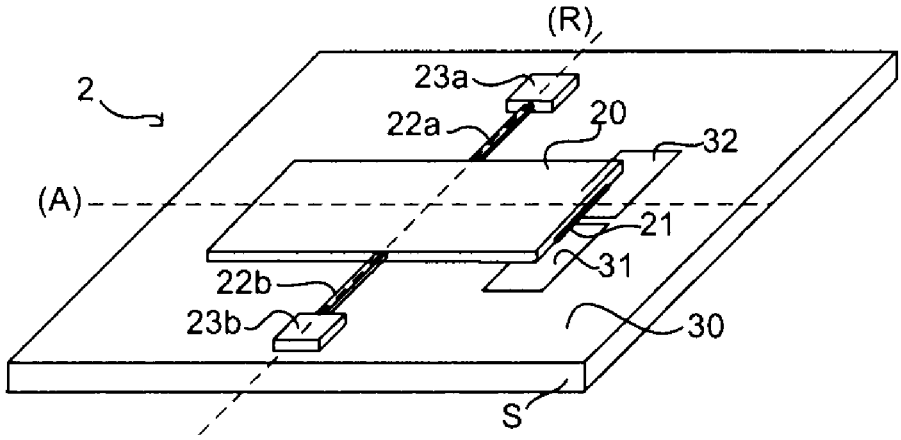
FIG. 1 represents a microswitch as used in the inventive control device.
Figure 3:
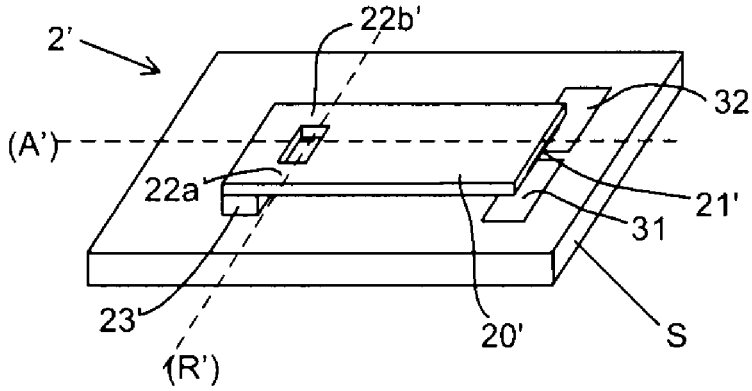
FIG. 3 shows another configuration of the microswitch employed.

FIGS. 1 and 3 show two different configurations of the microswitch. In the two configurations represented, the microswitch 2, 2' comprises a membrane 20, 20' fitted on a substrate S made of materials such as silicon, glass, ceramics or in the form of printed circuits. The substrate S bears, for example, on its surface 30 at least two conductive contacts or tracks 31, 32 that are flat, identical and spaced apart, designed to be electrically linked by a moving electrical contact 21, 21' in order to obtain the closure of an electrical circuit. The membrane 20, 20' is, for example, deformable and has at least one layer of ferromagnetic material. The ferromagnetic material is, for example, of the soft magnetic type and can be, for example, an alloy of iron and nickel ("permalloy" $Ni_{80}Fe_{20}$). Depending on the orientation of a lateral magnetic component, the membrane 20, 20' can assume a closed state in which its moving contact 21, 21' electrically links the two fixed conductive tracks 31, 32 so as to close the electrical circuit or an open state, in which its moving contact 21, 21' is separated from the two conductive tracks so as to open the electrical circuit.

In the first configuration of the microswitch 2 represented in FIG. 1, the membrane 20 has a longitudinal axis (A) and is joined to the substrate S via two linkage arms 22*a*, 22*b* linking said membrane 20 to two anchoring posts 23*a*, 23*b* arranged symmetrically either side of its longitudinal axis (A) and extending perpendicularly relative to this axis (A). By twisting of the two linkage arms 22*a*, 22*b*, the membrane 20 can pivot between its open state and its closed state on a rotation axis (R) parallel to the axis described by the points of contact of the membrane 20 with the electrical tracks 31, 32 and perpendicular to its longitudinal axis (A). The moving electrical contact 21 is positioned under the membrane 20, at one end of the latter.

In the second configuration of the microswitch 2' represented in FIG. 3, the membrane 20' has a longitudinal axis (A') and is linked, at one of its ends, via linkage arms 22*a*', 22*b*', to one or more anchor posts 23' joined to the substrate S. The membrane 20' is able to pivot relative to the substrate on an axis (R') of rotation perpendicular to its longitudinal axis (A'). The linkage arms 22*a*', 22*b*' form an elastic link between the membrane 20' and the anchor post 23' and are stressed to bend when the membrane 20' pivots.

Figure 2:
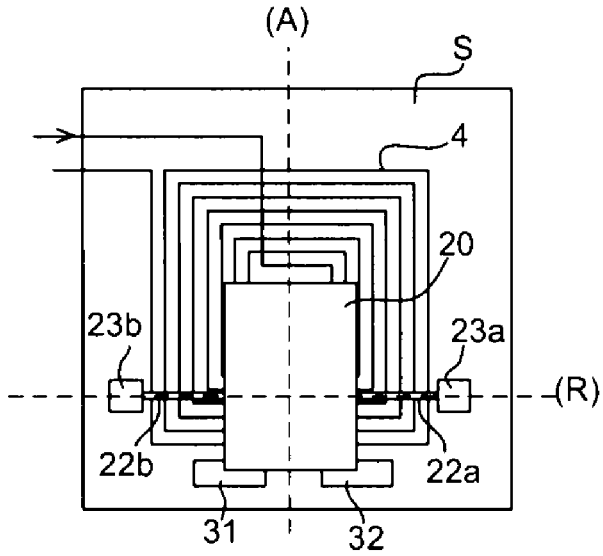
FIG. 2 represents a top view of the microswitch of FIG. 1 to which has been added a planar coil incorporated in the substrate.

In the inventive control device 1, 1', a planar excitation coil 4 is incorporated in the substrate of the microswitch 2, 2' as represented in FIG. 2. An excitation coil in solenoid form can also be employed. The solenoid then defines a space inside which the microswitch 2, 2' is housed.

Figure 4:
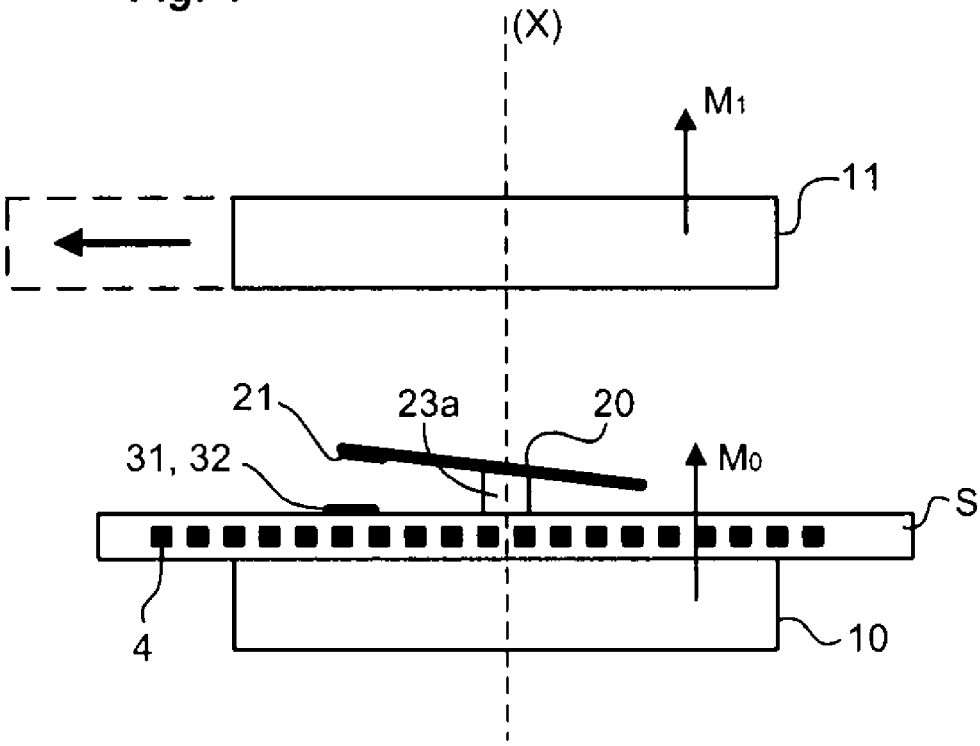
FIG. 4 shows a first embodiment of the inventive control device.
Figure 5:
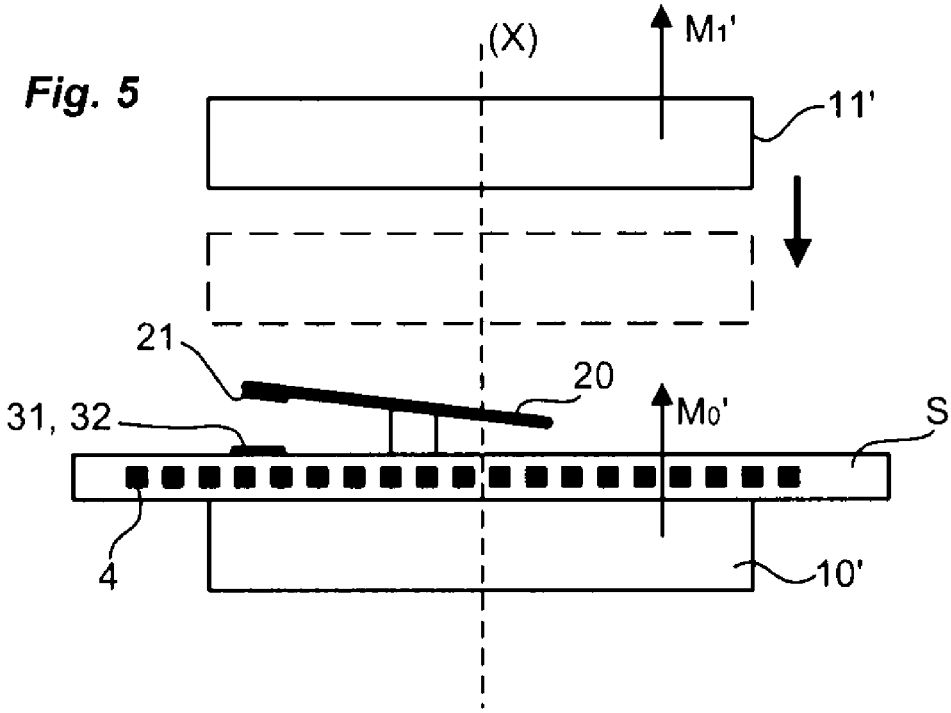
FIG. 5 shows a second embodiment of the inventive control device.

Referring to FIGS. 4 and 5, the inventive control device 1, 1' also comprises a moving permanent magnet 11, 11' and a fixed part made of magnetic material, that can, for example, be a ferromagnetic part (e.g.: FeNi) or a permanent magnet 10, 10', for example fixed under the substrate S of the microswitch. The moving permanent magnet 11, 11' is able to be moved between two positions, a first so-called rest position (in solid lines in FIGS. 4 and 5) and a second, temporary position of actuation of the microswitch (in dotted lines in FIGS. 4 and 5). In FIGS. 4, 5, the fixed permanent magnet 10, 10' and the moving permanent magnet 11, 11' have magnetizations $M_0$, $M_1$, $M_0'$, $M_1'$ of the same direction and of mutually parallel directions perpendicular to the surface 30 of the substrate S of the microswitch 2, 2'.

The moving permanent magnet 11, 11' can be actuated via a manual actuation member (not represented) to form a button or via a mechanical actuation member (not represented) to form a position sensor.

When the moving permanent magnet 11, 11' is in its rest position, the fixed part, consisting of a ferromagnetic part or of the fixed permanent magnet 10, 10', and the moving permanent magnet 11, 11' therefore generate between them a uniform permanent magnetic field $B_0$ having field lines that are substantially parallel to each other. Since the lateral magnetic component generated in the membrane 20, 20' by this uniform permanent magnetic field $B_0$ is weak, it is easy to cause the membrane to switch over to its other state by producing an opposite lateral magnetic component of greater intensity.

Depending on the direction of movement of the moving permanent magnet 11, 11', the control device 1, 1' comprises two distinct embodiments. These two embodiments are described with a fixed part consisting of a permanent magnet 10, 10'.

In a first embodiment represented in FIG. 4, the moving permanent magnet 11 is able to be moved in translation parallel to the surface 30 of the substrate S of the microswitch 2 and to the fixed permanent magnet 10 so as to impart a sliding-type actuation on the control device. The fixed permanent magnet 10 and the moving permanent magnet 11 in the rest position are centred relative to each other and the microswitch 2 is centred relative to the fixed 10 and moving 11 permanent magnets. The membrane 20 is, for example, initially in the open state.

In the second embodiment of the invention represented in FIG. 5, the moving permanent magnet 11' is able to be moved in translation along an actuation axis (X) perpendicular to the surface 30 of the substrate S of the microswitch 2 so as to impart a pushbutton-type actuation on the control device 1. The moving permanent magnet 11' therefore has a rest position separated from the fixed permanent magnet 10' and a temporary working position in which it is brought towards the fixed permanent magnet 11' along the actuation axis (X). In this second embodiment, the fixed permanent magnet 10' and the moving permanent magnet 11' are centred relative to each other and the microswitch 2 is off-centred laterally relative to the magnets 10', 11' so as to be able to favour a lateral magnetic component when the moving permanent magnet 11' is actuated to its working position.

The operation of a control device 1, 1' of the first embodiment or of the second embodiment is explained hereinbelow in conjunction with FIGS. 6A to 6E showing a microswitch 2 of the first configuration. It should be understood that the operation is identical with a microswitch 2' of the second configuration.

Figure 6A:
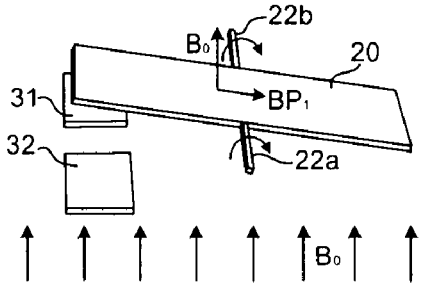
FIGS. 6A to 6E illustrate the operation of the inventive control device.

In FIG. 6A, the substrate S supporting the membrane 20 is placed under the effect of the uniform permanent magnetic field $B_0$ created between the fixed permanent magnet 10, 10' and the moving permanent magnet 11, 11', which is in its rest position. The uniform permanent magnetic field $B_0$ initially generates a magnetic component $BP_1$ in the membrane 20 along its longitudinal axis (A). The resultant magnetic torque holds the membrane 20 in one of its states, for example the open state in FIG. 6A.

Figure 6B:
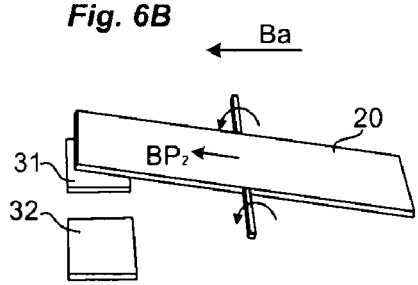
Figure 6C:
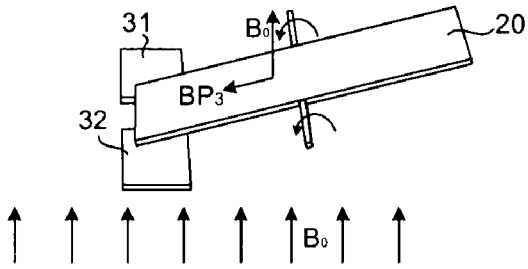

For each of the embodiments described hereinabove, the movement of the moving permanent magnet 11, 11' to its working position generates a lateral magnetic component Ba which creates a component $BP_2$ in the membrane 20 so as to reverse the magnetic torque exerted on the membrane and force the membrane to switch over to its other state, that is, the closed state (FIG. 6B). Once the membrane 20 has switched over to its closed state, the moving permanent magnet 11, 11' returns to its initial rest position. The return of the moving permanent magnet can be achieved simply by using the magnetic interaction with the fixed permanent magnet in the case of the sliding actuation member (FIG. 4) or via a spring (not represented) in the case of the pushbutton-type actuation member (FIG. 5). When the moving permanent magnet 11, 11' is returned to its rest position, the uniform permanent magnetic field $B_0$ is once again formed between the two magnets and creates a magnetic component $BP_3$ forcing the membrane 20 to its new state, that is, the closed state (FIG. 6C).

The moving permanent magnet 11, 11' is designed to switch over the membrane only from one state to the other. Consequently, to return the membrane to its initial state, the second actuation mode is used, that is, the excitation coil 4. This second actuation mode has the advantage of being able to be actuated remotely by injection of a current into the coil 4 in an appropriate direction.

Figure 6D:
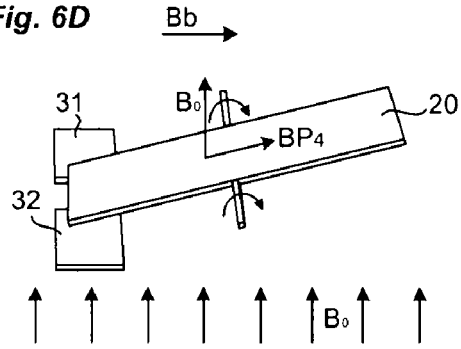

Referring to FIG. 6D, the passage of a control current in a defined direction through the excitation coil 4 makes it possible to generate the temporary controlling magnetic field Bb, the direction of which is parallel to the substrate S, its direction depending on the direction of the current delivered into the coil 4. The temporary magnetic field Bb thus generates the magnetic component $BP_4$ in the membrane 20 opposing the magnetic component $BP_3$ and of greater intensity than the magnetic component $BP_3$ so as to reverse the magnetic torque and cause the membrane 20 to switch over from its closed state to its open state.

Figure 6E:
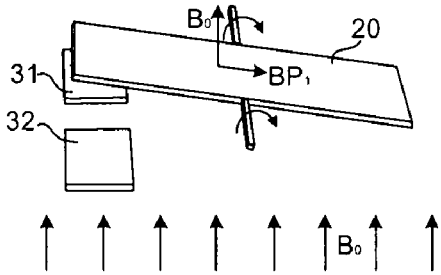

Once the membrane 20 has been switched over, the current supplied to the coil 4 is no longer needed. According to the invention, the magnetic field Bb is generated only transiently to switch over the membrane 20 from one state to the other. In FIG. 6E, the microswitch is therefore in a state identical to that represented in FIG. 6A.

Of course, it should be understood that the control device 1, 1' can be controlled differently. The membrane 20, 20' can, for example, be initially in the closed state. Similarly, the first actuation of the membrane can be performed using the coil 4 and the second actuation using the moving permanent magnet 11, 11'. Depending on the applications, all the operating configurations are therefore possible. Moreover, the device can be configured to be able to close and open the circuit by using only the moving permanent magnet or by using only the coil by injecting therein a positive current or a negative current.

A first application consists, for example, in eliminating the leakage or standby currents of a system operating on a button cell or other battery and thus obtain energy savings. The inventive control device can be used to switch on the product manually by acting on the moving permanent magnet which causes the membrane to switch over from the initial open state to the closed state. Then, when the system has finished its task or after a certain time, the product can be returned to standby automatically by a current being sent into the excitation coil of the control device to cause the membrane to switch over to its open state and thus open the electrical circuit. The product supplied with power can, for example, be a wireless switch or an alarm or door-opening remote control. The use of the control device for this application makes it possible in particular to ensure, when the product is sold, that the battery or the button cell has not been fully discharged by its standby currents.

A second application of the inventive control device consists, for example, in eliminating the leakage currents of the transformers for the AC/DC power supplies designed to power or recharge roaming appliances such as, for example, mobile phones, digital walkmen or photographic appliances. The small transformers have very low efficiencies that mean mains power supplies have to be produced that consume as much offload as the load that they are required to power. An inventive control device 1, 1' is thus used to automatically switch off the standby currents of the system on detection of a weak charging current. By sending a current into the excitation coil, the membrane switches over from a closed state to an open state of the electrical circuit. To switch on the system again, all that is then required is to act on the moving permanent magnet via a button to set the membrane to its closure state. The same control principle can, for example, be applied in a third application.

This third application consists in using the inventive control device in a circuit breaker. On detection of a fault, the current is switched off automatically by sending a current into the excitation coil which switches over the membrane from the closed state to the open state. To reclose the electrical circuit, the actuation of the moving permanent magnet makes it possible to return the membrane from its open state to its closed state.

A final application can, for example, consist in using the control device in a sensor, for example wireless and standalone, able to communicate by wireless link with a main transceiver unit. The inventive device makes it possible, for example, to switch off the sensor once a data transmission has been completed.

It should be understood that it is possible, without departing from the framework of the invention, to devise other variants and refinements of details and similarly consider the use of equivalent means.

The invention claimed is:

1. A control device of an electrical circuit comprising:

a microswitch including a moving element that is configured to be driven by magnetic effect between a first stable state and a second stable state to control the electrical circuit;

a fixed part made of magnetic material;

a moving permanent magnet that is configured to be actuated between a first position, in which it forms, with the fixed part, a substantially uniform permanent magnetic field holding the moving element in the first state or the second state, and a second position in which it is able to control switchover of the moving element from one state to the other; and an excitation coil configured to create a temporary magnetic field able to cause the moving element to switch over from one state to the other when the moving permanent magnet is in the first position.

2. The control device according to claim 1, wherein the fixed part made of magnetic material is a permanent magnet.

3. The control device according to claim 2, wherein the moving permanent magnet and the fixed permanent magnet have magnetizations of parallel direction and of the same direction.

4. The control device according to claim 3, wherein the magnetic field created by the coil is substantially perpendicular to the magnetization directions of the fixed and moving permanent magnets.

5. The control device according to claim 3 or 4, wherein the moving permanent magnet is able to be moved perpendicularly to its direction of magnetization.

6. The control device according to claim 5, wherein the microswitch is centered relative to the fixed and moving permanent magnets.

7. The control device according to claim 3 or 4, wherein the moving permanent magnet is able to be moved parallel to its direction of magnetization.

8. The control device according to claim 7, wherein the microswitch is off-centered relative to the fixed and moving permanent magnets.

9. The control device according to claim 1, wherein the moving element of the microswitch is a ferromagnetic membrane that can be oriented along magnetic field lines.

10. The control device according to claim 1, wherein, after actuation, the moving permanent magnet is automatically returned from its second position to its first position.

11. The control device according to claim 1, wherein:

the moving element is initially held in the first state, then the moving element is switched over to the second state by movement of the moving permanent magnet to its second position, and the moving element is returned to its first state by activation of the coil once the moving permanent magnet has returned to its first position.

12. The control device according to claim 11, wherein the first state of the moving element is an open state in which the electrical circuit is open and in that the second state is a closed state in which the electrical circuit is closed.

13. A circuit breaker that comprises the control device of claim 1, wherein the circuit breaker is configured to automatically disconnect the electrical circuit using the excitation coil and then manually re-engage the electrical circuit using the moving permanent magnet.

14. A method, implemented on a control device of an electrical circuit that includes a microswitch having a moving element that is configured to be driven by magnetic effect between a first stable state and a second stable state to control the electrical circuit, a fixed part made of magnetic material, a moving permanent magnet that is configured to be actuated between a first position, in which it forms, with the fixed part, a substantially uniform permanent magnetic field holding the moving element in the first state or the second state, and a second position in which it is able to control switchover of the moving element from one state to the other; and an excitation coil able to create a temporary magnetic field able to cause the moving element to switch over from one state to the other when the moving permanent magnet is in the first position, the method comprising:

disconnecting the electrical circuit by activation of the coil; and re-engaging the electrical circuit using the moving permanent magnet.

* * * * *